US007641103B1

(12) United States Patent
Tomich

(10) Patent No.: US 7,641,103 B1
(45) Date of Patent: Jan. 5, 2010

(54) WALL MOUNTED LOG CHUTE

(75) Inventor: Wayne K. Tomich, Gagetown, MI (US)

(73) Assignee: Joan Tomich, Gagetown, MI (US)

( * ) Notice: Subject to any disclaimer, the term of this patent is extended or adjusted under 35 U.S.C. 154(b) by 0 days.

(21) Appl. No.: 12/006,485

(22) Filed: Jan. 3, 2008

(51) Int. Cl.
*A47G 29/12* (2006.01)

(52) U.S. Cl. ..... 232/43.4; 232/44; 232/1 E; 220/479

(58) Field of Classification Search ..... 232/44, 232/43.4, 43.5, 19, 1 E; 193/34; 109/19; 220/479
See application file for complete search history.

(56) References Cited

U.S. PATENT DOCUMENTS 1,789,123 A * 1/1931 Triggs ..... 193/33
3,189,265 A * 6/1965 Franklin ..... 232/19
4,117,777 A * 10/1978 Schipman ..... 100/215
4,278,163 A 7/1981 Tomich

* cited by examiner

*Primary Examiner*—William L. Miller
(74) *Attorney, Agent, or Firm*—Robert L. McKellar; McKellar IP Law, PLLC

(57) ABSTRACT

A wall mounted log chute for holding and transferring fire wood through a wall of a dwelling is disclosed. The chute is mounted within the confines of the wall of a dwelling and having an outside and an inside position. In the outside position the chute is capable of receiving fire wood and other materials. These other materials include but are not limited to coal, feed, bio fuels and household refuse. The chute is capable of material transfer of any nature. When the desired amount of wood or other material is arrived at the chute is mechanically or manually operable from the outside position to the inside position. The reverse operation is also true. The chute is capable of holding the wood in the inside position and a storing facility or can be emptied to repeat the process. One embodiment allows the chute to be controlled from the first position to the second position by a hydraulic arm and an electrical switch.

10 Claims, 4 Drawing Sheets

WALL MOUNTED LOG CHUTE

The present invention deals with a device that is capable of holding and transferring fire wood from and outside location to an inside location for the purpose of burning.

BACKGROUND OF THE INVENTION

The use of log chutes to move fireplace wood and suitable fuels from the exterior to the interior of a building is not new. This is specifically covered in the applicants prior art patent titled, Wall mounted log chute, issued to Wayne K. Tomich, on Jul. 14, 1981. The instant invention is an improvement upon the former invention in that it allows the wall mounted log chute to be operated either mechanically, electrically or hydraulically. This improvement allows the wall mounted log chute to operate easier and smoother. Before the operator would load the chute at the exterior of the building then proceed inside to manually pull the chute into the interior of the building. The current improvement allows for the same procedure except the operator arrives inside and pulls the chute into the inside with the aid of mechanical applications, hydraulic applications or electrically activated applications to move the chute safely and easily with little or no human effort.

THE INVENTION

An improved wall mounted log chute comprising in combination of a wall opening, a wall opening framework, a hopper, a pivotal hinge, an arm, an air curtain and a pivoting mechanism. The wall opening consists of an opening from the exterior of a building through to the interior of a building. The wall openings framework of the log chute consisting of a weather proof insertable structure that secures the log chute inside of the wall opening.

The hopper is the interior portion of the log chute that capable of retaining or holding fireplace wood or other fireplace fuels. The pivotal hinge allows the log chute to move from the exterior to the interior of a building. The arm is the mechanical portion of the improvement allowing for effortless movement of the log chute from the exterior position to the interior position.

DETAILED DESCRIPTION OF THE DRAWINGS

Figure 1:
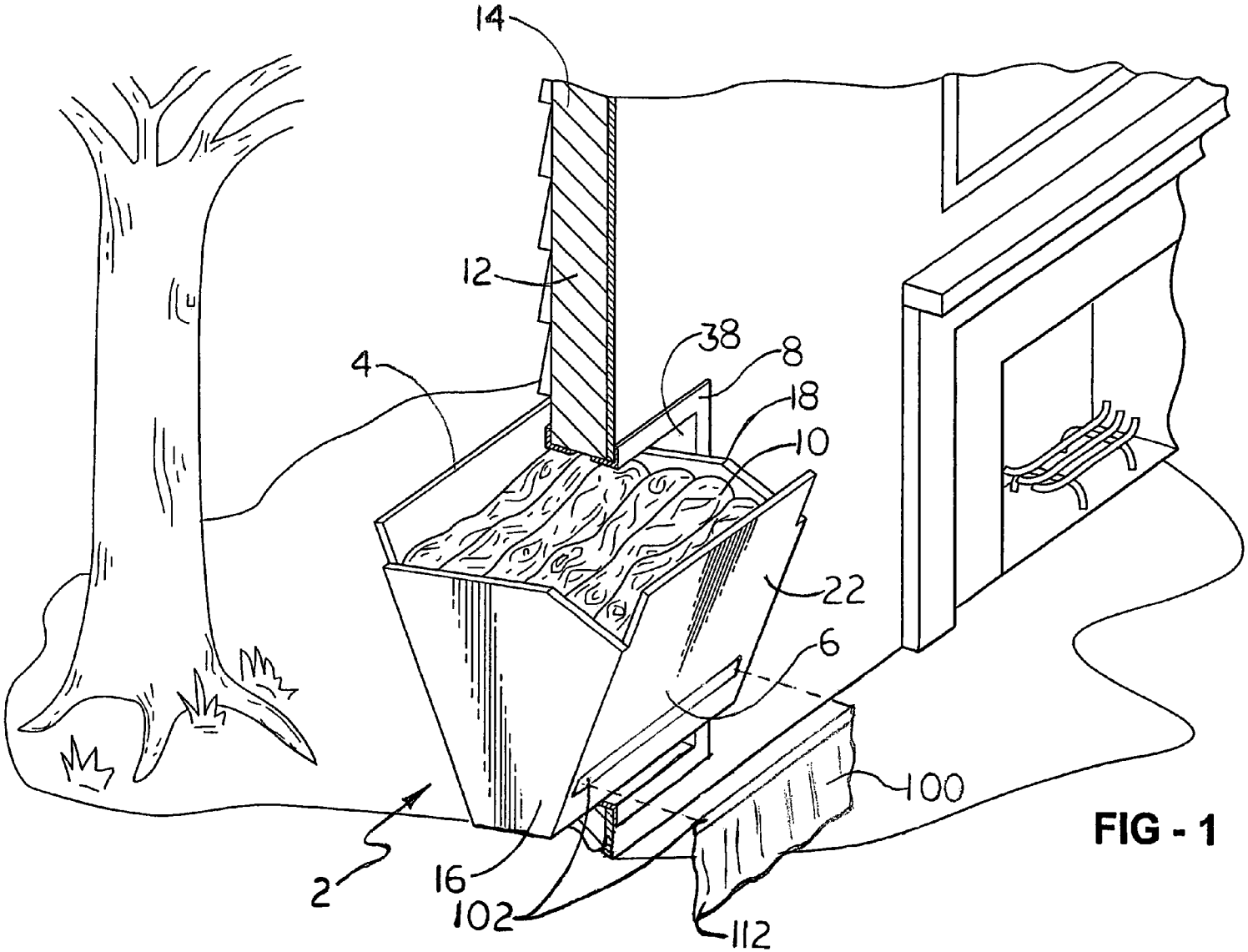
FIG. 1 is side view of the improved log chute in the second position.

FIG. 1 is side view of the improved log chute 2 in the second position 22. In this position the log chute 2 is easily unloaded. The building 14 has an opening 38 through the wall

12 that contains a wall mounted frame 8. The wall mounted frame 8 retains the log chute 2. The log chute 2 allows the user the ability to load fire wood 10 from an outside location then move inside and manipulate the log chute 2 to its second position 22 for unloading within the building 14. The log chute 2 has a near end 16 and a distal end 18. The log chute 2 has a first side 4 and a second side 6. When the log chute 2 is in the loading position 20 the first side 4 or exterior side allows wood to be loaded within in the log chute 2. Accordingly the opposite is true for unloading. Also present is an air curtain 100 that is removably attached by way of Velcro 102 on the curtain 100 and the log chute 2. The main function of the air curtain 100 is to prevent the flow of air from the inside out and from outside in. There is no draft when the log chute 2 is in the out position.

Figure 2:
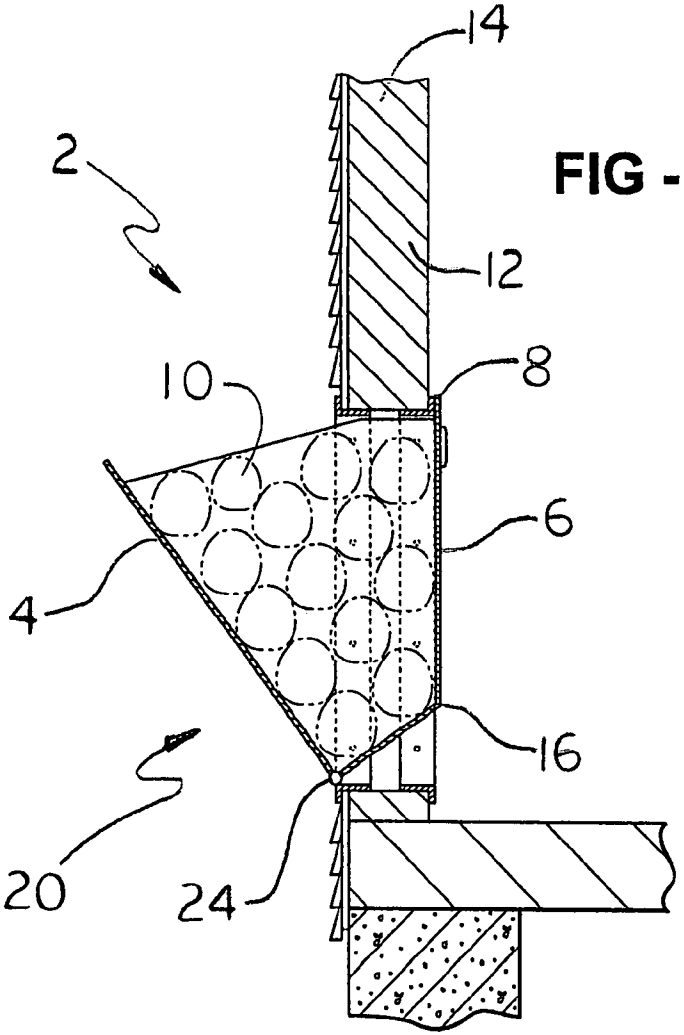
FIG. 2 is a side view showing the improved log chute in the first position.

FIG. 2 is a side view showing the improved log chute 2 in the first position 20. This view shows the loading position 20 or first position 20 where the log chute 2 is loaded with fire wood 10 from the outside of a building 14. While the log chute 2 is in this position the second side 6 rests tightly against the frame 8 mounted in wall 12 preventing outside elements from entering the building 14. This view also shows the pivoting hinge 24 that allows the log chute 2 the ability to move to the second position 22. The first side 4 and the second side 6 serve to maintain the element barrier by interfacing with the frame 8 depending on the position of the log chute 2. When the log chute is in the loading position 20 the second side 6 rests firmly against the frame 8 preventing air flow into the building 14 and when it is in the unloading 20 or second position 20 the first side 4 fits against the frame 8 preventing air flow as well.

Figure 3:
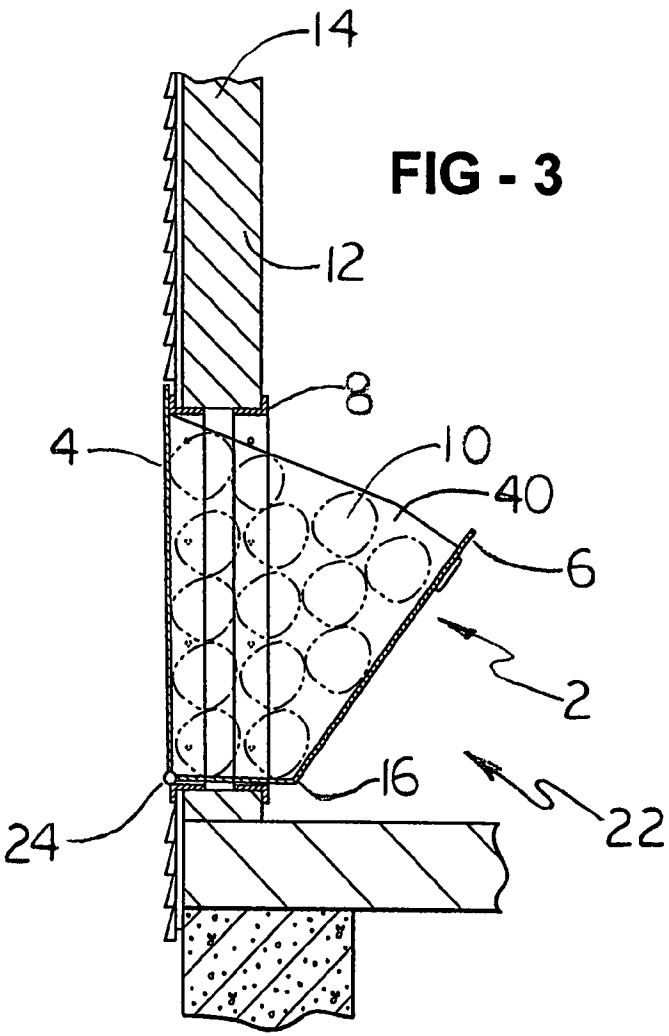
FIG. 3 is a side view showing the improved log chute in the second position.

FIG. 3 is a side view showing the improved log chute 2 in the second position 22. This view shows the opposite of FIG. 2 where the log chute 2 is in the unloading position 22 or second position 22. The log chute 2 has been moved on the pivoting hinge 24 moving the opening 40 to the interior of the building 14 for unloading.

Figure 4:
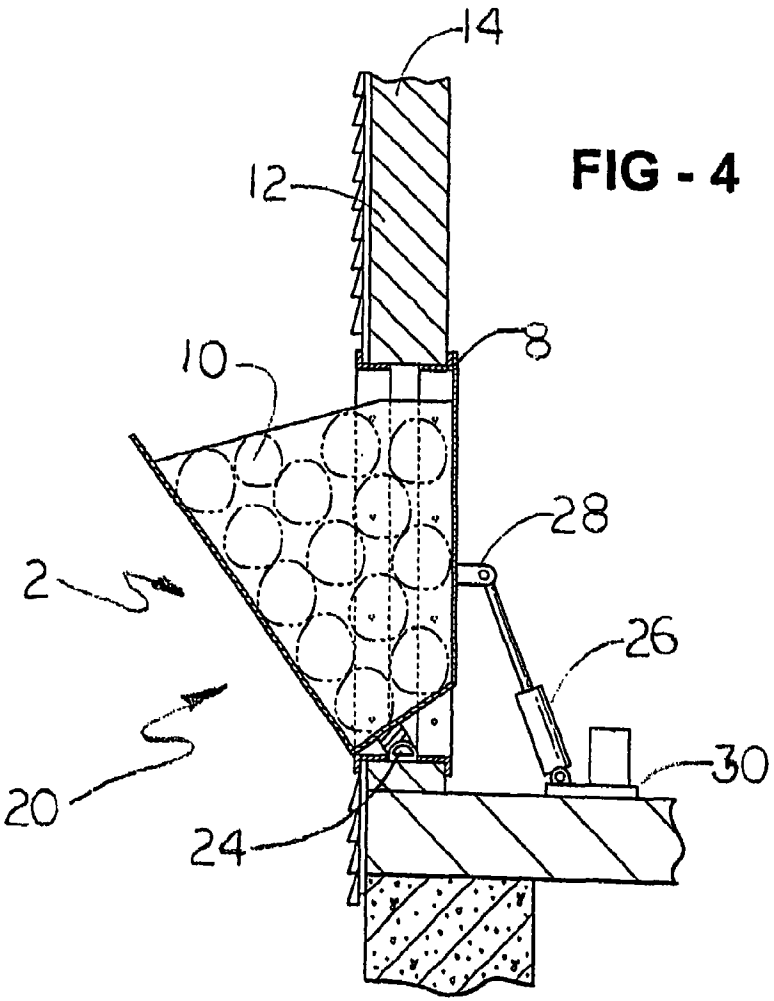
FIG. 4 is a side view showing the improved log chute in the first position with the arm in the extended position.

FIG. 4 is a side view showing the improved log chute 2 in the first position 20 with the arm 26 in an extended position. This view expresses the essence of the improvement to the log chute 2. The improvement in the log chute 2 is the ability to manipulate the position of the log chute 2 with the aid of an arm 26. This arm 26 is operated by mechanical, hydraulic or other mechanisms that accomplish the movement of the log chute 2 from its first position 20 to its second position 22 and back again. In this embodiment the movement is facilitated by the use of a hydraulic arm 26. This allows the user to manipulate the log chute 2 effortlessly reducing the potential for injury. It also allows the user to be one of lesser physical strength to accomplish the same task.

Figure 5:
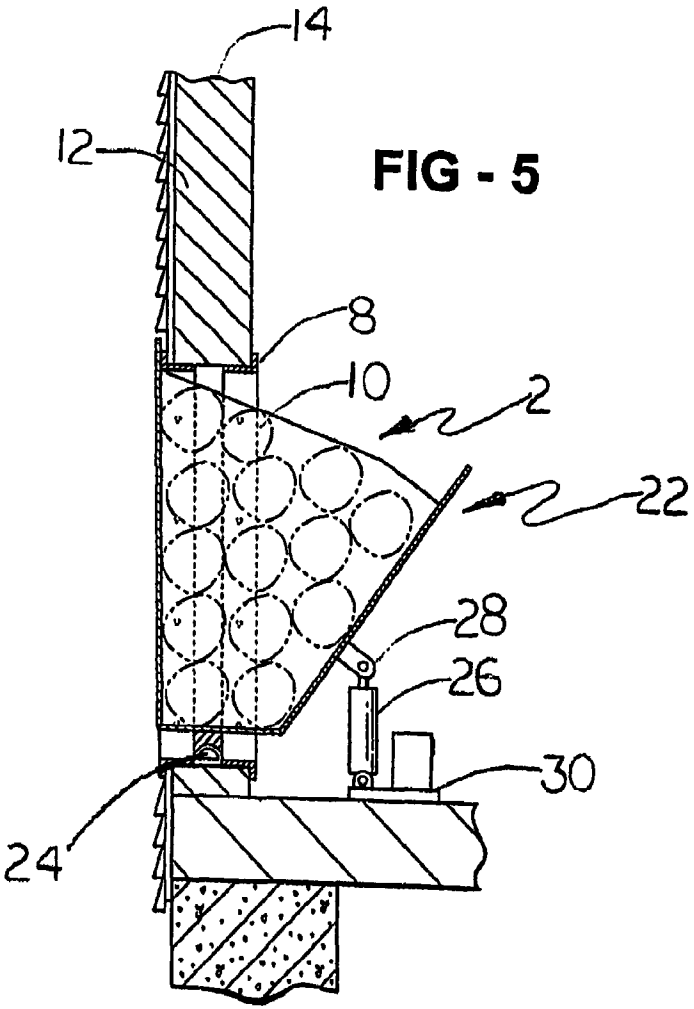
FIG. 5 is a side view showing the improved log chute in the second position with the arm retracted.

FIG. 5 is a side view showing the improved log chute 2 in the second position 22 with the arm 26 retracted. This view shows the log chute 2 after it has been moved to the second position 22 with the help of the arm 26. Both FIG. 4 and FIG. 5 show the adaptation of the arm 26 to the log chute 2. The arm 26 is connected to the second side 6 of the log chute 2 at connection point 28. The arm 26 is attached to the base 30 which is mounted within a close approximation to the log chute 2. 32 is the operating system for the arm, it can be manual, it can be electrically powered, it can be air driven, it can be hydraulically driven or any other means of operating the arm.

Figure 6:
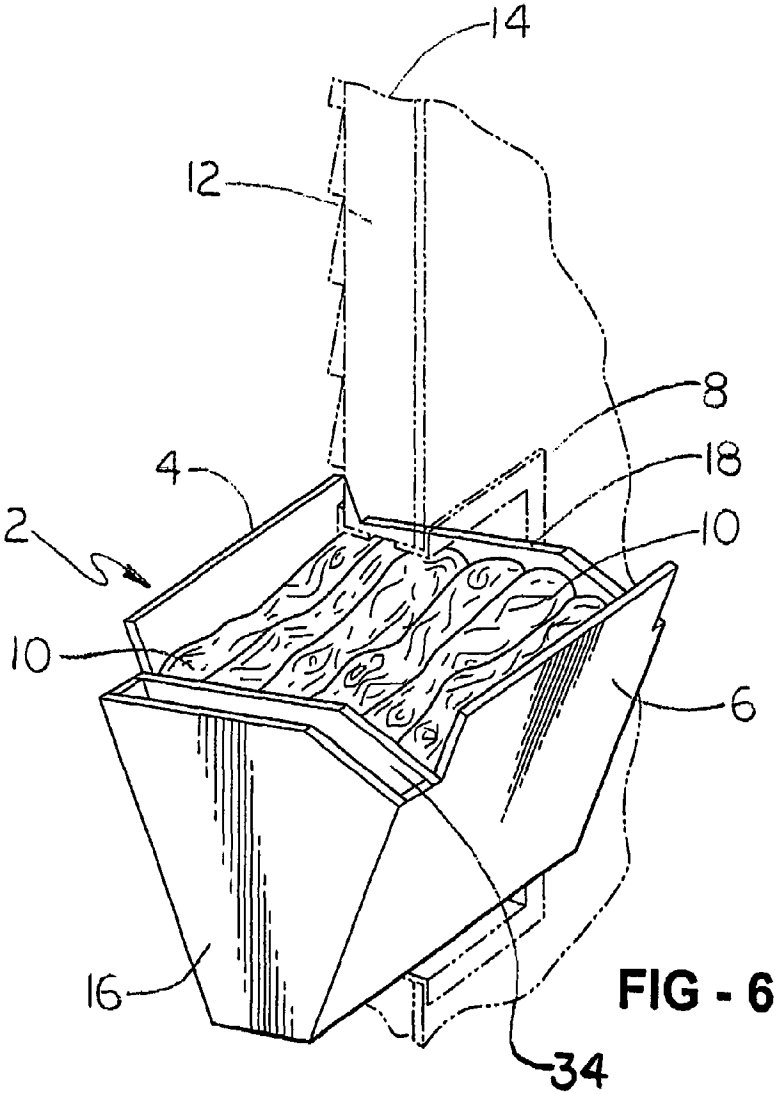
FIG. 6 is a side view showing the improved log chute with the interior cavity that holds one embodiment of the placement of the arm.

FIG. 6 is a side view showing the improved log chute 2 with the interior cavity 34 that holds one embodiment of the placement of the arm 26. This cavity 34 is incorporated into the log chute to protect the arm 26 and its operating system during operation.

Figure 7:
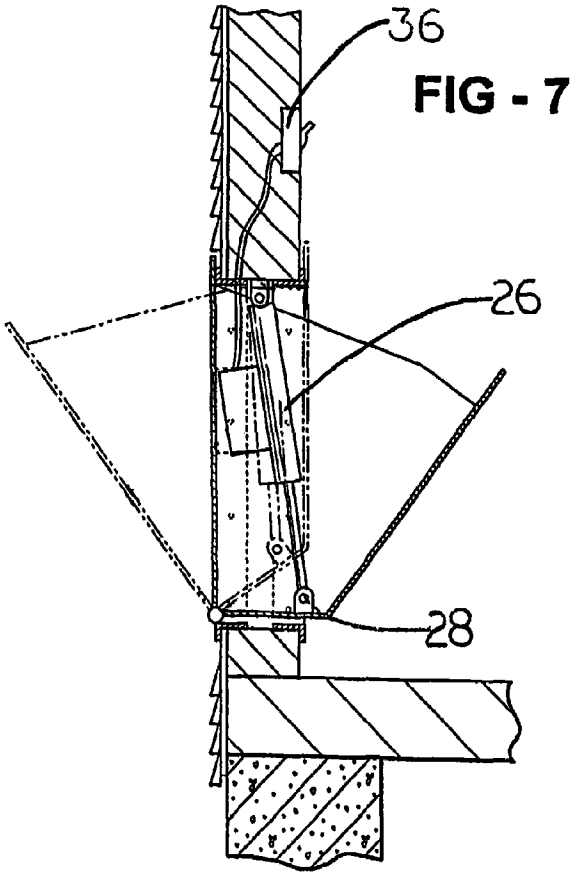
FIG. 7 is a side view showing the placement of the arm within the cavity and being electronically powered.

FIG. 7 is a side view showing the placement of the arm 26 within the cavity 34 and being electronically powered. This is embodiment utilizes an electric switch 36 that when activated it energizes a motor that will manipulate the arm 26 moving the log chute 2 from its first position 20 or the loading position 20 to the second position 22 or its unloading position 22. Here the arm 26 is connected internally to the log chute 2 and operates from the internal cavity 34 for the manipulation of the log chute 2. The air curtain can be manufacture from any material that is suitable for the purpose of creating a barrier that is capable of preventing the outside environment from coming into the dwelling equipped with the log chute 2.

The log chute 2 is also available as a construction kit comprising at least one of each of the following;

a. 2 pounds of drywall screws,
b. 2 pounds of exterior screw,
c. 1 piano hinge,
d. 1 side panel A,
e. 1 side panel B,
f. 1 front panel C,
g. 1 back panel D,
h. 1 bottom panel E,
f. 2 steel handle,
i. dowel rod with carriers,
j. 4 tubes of liquid nail,
k. ½"×4×8 foam insulation,
l. 8 framing pieces,
m. 2 slide locks,
n. 1 can of spray adhesive,
o. 1 roll of 1"×12" self adhesive foam weather stripping,
p. 12 pieces of bracing,
q. 2 pieces of 1"×2" bracing for the piano hinge,
r. 9 pieces of bottom bracing,
s. inner liner of inside panel D,
t. 8 ninety degree corner framing braces with fasteners,
u. 1 curtain with Velcro for bottom.

What is claimed is:

1. An improved wall mounted log chute consisting essentially of:

a wall opening, said wall opening consisting of an opening from the exterior of a building through to the interior of a building;

said wall opening being framed on the exterior and the interior by a framework consisting of a weatherproof insertable structure used for securing said log chute in said opening;

a hopper, said hopper having an exterior bottom edge, said exterior bottom edge having a hinge with two sides, one side being attached to the bottom edge, the second side of the hinge being attached to the framework;

said hopper being capable of movement from the exterior to the interior and from the interior to the exterior, said hopper capable of containing fireplace fuel;

an arm, said arm having a distal end and a near end and said distal end attached to the hopper for driving the hopper;

a pivoting mechanism, said pivoting mechanism being attached to the near end of the arm and said mechanism capable of driving the arm;

an air curtain, said air curtain being removably attached to said log chute and forming a barrier between the outside environment and the inside environment.

2. An improved wall mounted log chute as claimed in claim 1 wherein the pivoting mechanism is mechanical.

3. An improved wall mounted log chute as claimed in claim 1 wherein the pivoting mechanism is electrically operated.

4. An improved wall mounted log chute as claimed in claim 1 wherein the pivoting mechanism is hydraulically operated.

5. An improved wall mounted log chute as claimed in claim 1 wherein the pivoting mechanism is pneumatically operated.

6. An improved wall mounted log chute consisting essentially of:

a wall opening, said wall opening consisting of an opening from the exterior of a building through to the interior of a building;

said wall opening being framed on the exterior and the interior by a framework consisting of a weatherproof insertable structure used for securing said log chute in said opening;

a hopper, said hopper having an exterior bottom edge, said exterior bottom edge having a hinge with two sides, one side being attached to the bottom edge, the second side of the hinge being attached to the framework, said hopper having a side pocket on at least one side, said side pocket containing a means for moving the hopper from the interior of a building to the exterior of the building and return, said moving means being connected to the hopper and to the framework of the weatherproof insertable structure;

said hopper being capable of movement from the exterior to the interior and from the interior to the exterior, said hopper capable of containing fireplace fuel;

said moving means comprising an arm, said arm having a distal end and a near end and said distal end attached to the hopper for driving the hopper;

said moving means further comprising a pivoting mechanism, said pivoting mechanism being attached to the near end of the arm and said mechanism capable of driving the arm;

an air curtain, said air curtain being removably attached to said log chute and forming a barrier between the outside environment and the inside environment.

7. An improved wall mounted log chute as claimed in claim 6 wherein the pivoting mechanism is mechanical.

8. An improved wall mounted log chute as claimed in claim 6 wherein the pivoting mechanism is electrically operated.

9. An improved wall mounted log chute as claimed in claim 6 wherein the pivoting mechanism is hydraulically operated.

10. An improved wall mounted log chute as claimed in claim 6 wherein the pivoting mechanism is pneumatically operated.

* * * * *